US005528876A

United States Patent [19]

Lu

[11] Patent Number: 5,528,876

[45] Date of Patent: Jun. 25, 1996

[54] WALL STRUCTURE FOR BUILDINGS

[76] Inventor: Sin-Yuan Lu, 123-2, Song-Jow, Song-Jow Tsun, Guam Miao Hsiang, Tainan Shien, Taiwan

[21] Appl. No.: 239,507

[22] Filed: May 9, 1994

[51] Int. Cl.[6] ..... E04H 12/00

[52] U.S. Cl. ..... 52/654.1; 52/443; 52/649.1; 52/672; 52/425

[58] Field of Search ..... 52/649.1, 672, 52/444, 454, 425, 426, 600, 601, 654.1, 671, 443, 562, 581, 676, 815, 816

[56] References Cited

U.S. PATENT DOCUMENTS

| | | | |
|---|---|---|---|
| 1,359,675 | 11/1920 | Davidson | 52/648.1 X |
| 1,776,560 | 9/1930 | Kreil | 52/649.1 X |
| 3,313,074 | 4/1967 | Huntley | 52/654.1 X |
| 3,332,188 | 7/1967 | Schaefer | 52/654.1 X |
| 3,461,639 | 8/1969 | Merrill | 52/654.1 X |
| 3,559,355 | 2/1971 | Day | 52/672 X |

FOREIGN PATENT DOCUMENTS

| | | | |
|---|---|---|---|
| 1009591 | 3/1952 | France | 52/654.1 |
| 1103507 | 11/1965 | United Kingdom | 52/454 |

*Primary Examiner*—Carl D. Friedman
*Assistant Examiner*—David J. Jersen
*Attorney, Agent, or Firm*—Bacon & Thomas

[57] ABSTRACT

A wall structure for buildings comprising a plurality of vertical frames spaced equidistant and two steel nets welded with the front side and the rear side of the frames to form a front and a rear side of a wall, each frame consisting of two vertical parallel bars, a zigzag bar welded on and between the two vertical bars, and two vertical parallel angle steel posts welded on the outer sides of the two vertical parallel bars, the two steel nets respectively having a plurality of horizontal semi-round ridges spaced equidistant to strengthen the nets and being fastened with the front surfaces of the front and the rear vertical parallel steel posts, concrete material being poured in the empty space surrounded by the vertical frames and the two metal nets for forming a wall of a building.

1 Claim, 6 Drawing Sheets

WALL STRUCTURE FOR BUILDINGS

BACKGROUND OF THE INVENTION

A conventional reinforced concrete wall is made by placing steel bars and then concrete forms are bound on the steel bars at a front and a rear surface to form a limited space for concrete material to be poured therein and then being left to harden, forming a reinforced concrete wall with the concrete forms taken away. This kind of RC structure necessitates rather much work and time, having the following disadvantages.

1. Concrete forms are liable to rotten away, having rather short service life, requiring work for fixing on steel bars before a concrete wall is built, and work for taking away the combined concrete forms after the wall is finished, a resultant much time for work.

2. It takes considerable time to combine together concrete forms.

3. The thickness of a wall built by means of wooden concrete forms may not be even, having very rough surfaces.

4. Two layers of wooden concrete forms may be harmed or broken during binding them together by steel wire, which may cause accidental falling down of a wooden concrete form to potentially wounding workers at the site.

5. After wooden concrete forms are taken away, surfaces of the wall built may be very rough and grow cracks after a period of time.

6. Fittings for water and electricity have to be bound on steel bars in a wall in fixing them, wasting work.

SUMMARY OF THE INVENTION

The present invention has been devised to improve the above mentioned conventional reinforced wall for buildings, wherein a plurality of vertical frames and two metal nets welded on the frames to form a reinforced wall with concrete material poured in an empty space surrounded by the two most outer vertical frames and the two steel nets.

Each vertical frame consists of two vertical parallel bars spaced in a distance of the thickness of a wall to be built, a zigzag bar welded on and between the two vertical parallel bars, and two vertical parallel angle steel posts welded with outer sides of the two vertical parallel bars, and two steel nets cut from continuous steel net material to have a length of the length of a wall to be built and strengthened with a plurality of horizontal semi-round ridges spaced equidistant. Then the two steel nets are respectively fastened on a front and a rear side of each spaced-apart frame by means of screws with the vertical parallel angle steel posts.

After the frames and the steel nets are combined together, concrete material is poured into the empty space formed by the two most outer frames and the two nets to form a reinforced concrete wall after the concrete material hardens.

DETAILED DESCRIPTION OF THE INVENTION

Figure 1:
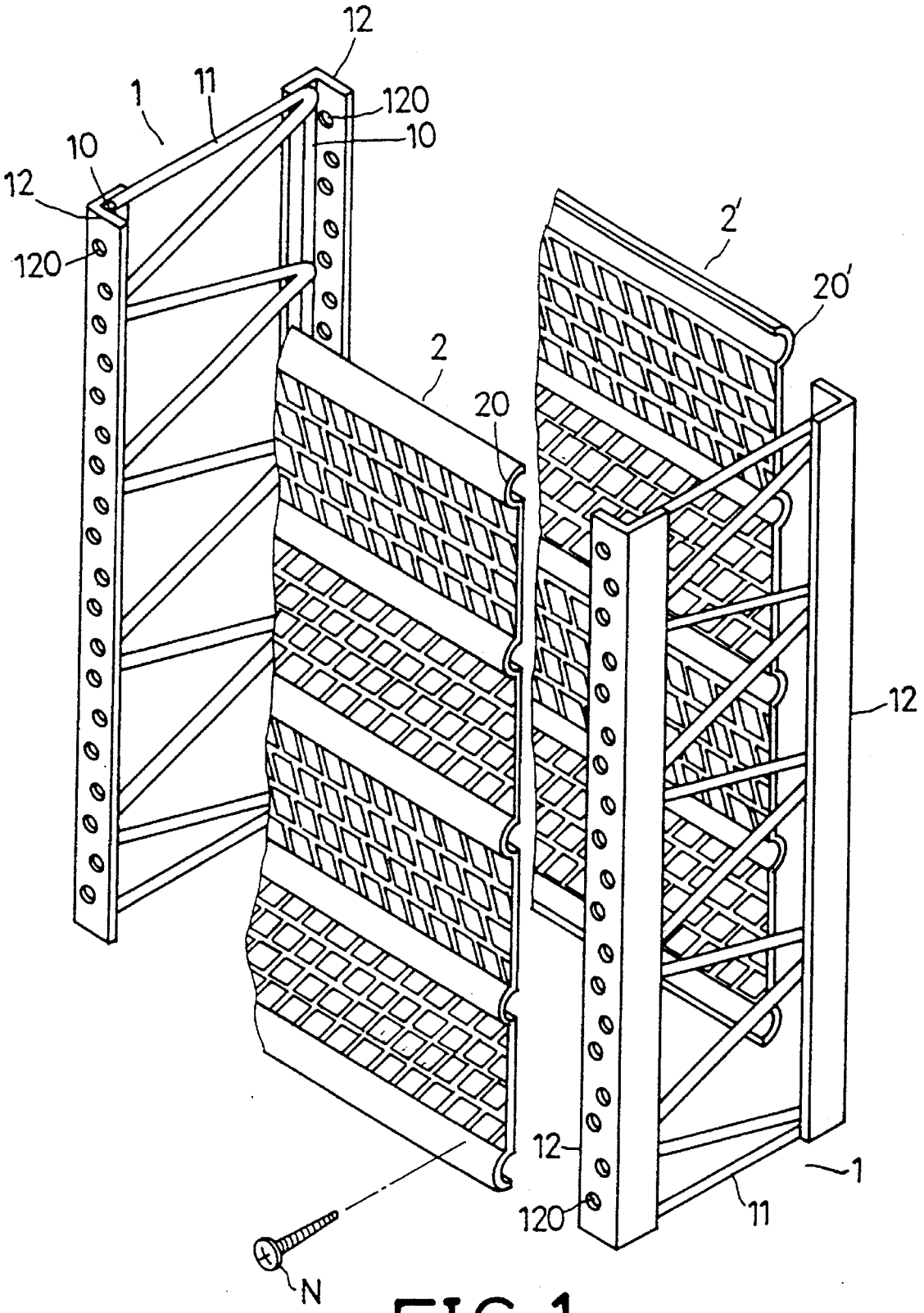
FIG. 1 is an exploded perspective view of a first embodiment of a wall structure for buildings in the present invention.
Figure 2:
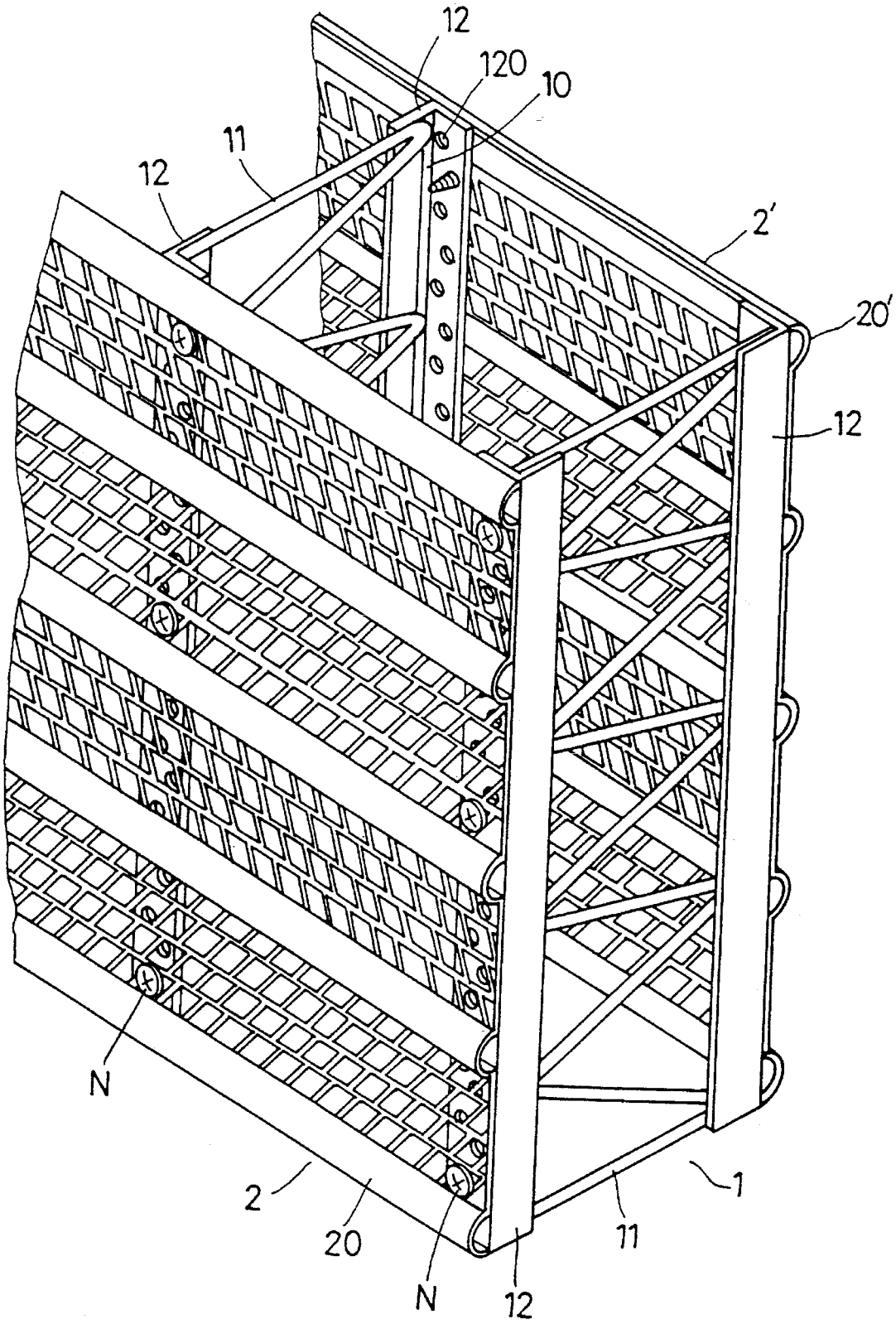
FIG. 2 is a perspective view of the first embodiment of the wall structure for buildings in the present invention.
Figure 3:
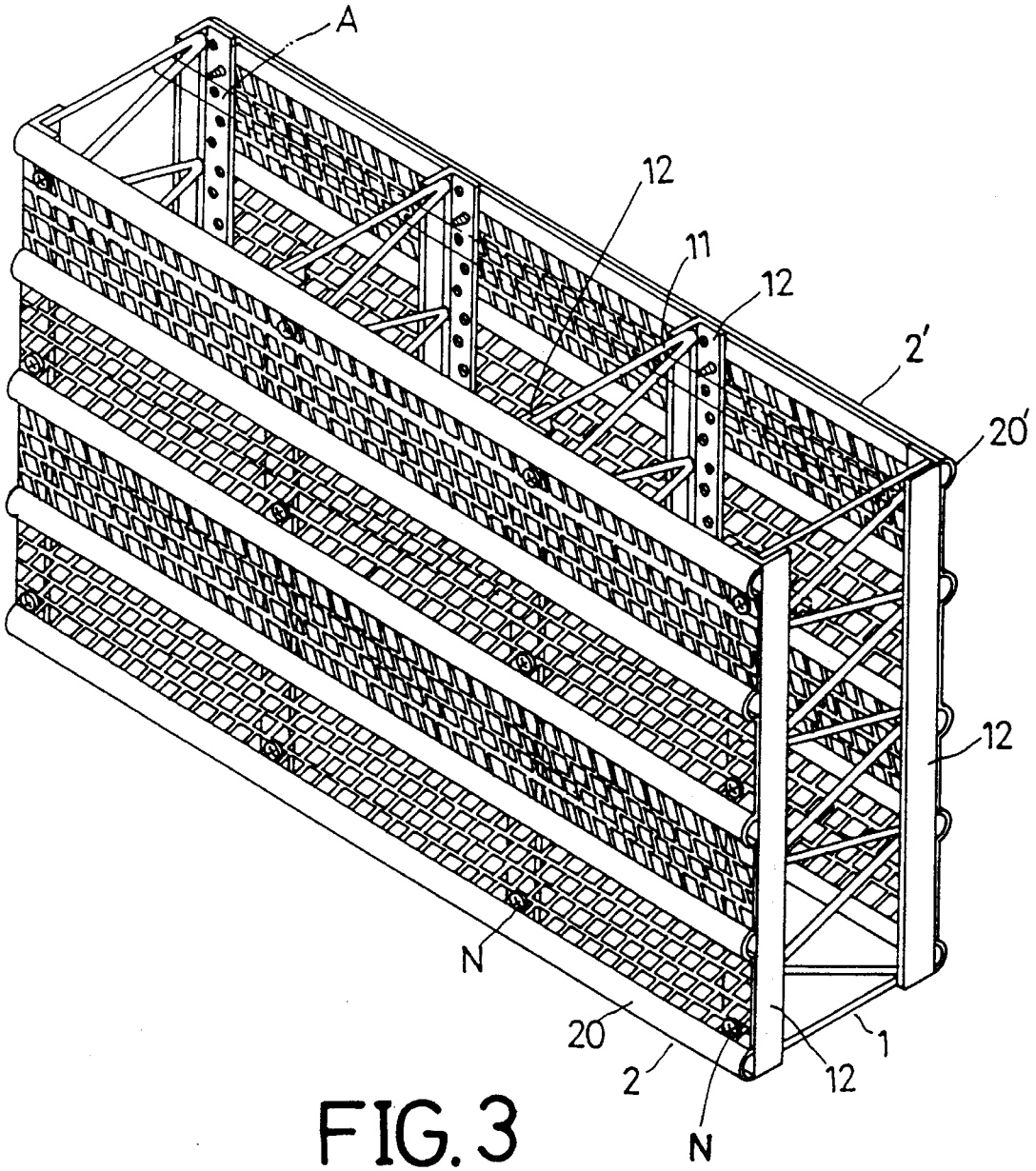
FIG. 3 is a perspective view of the first embodiment of the wall structure for buildings in the present invention, showing a wall formed by means of this structure.

A wall structure for buildings in the present invention, as shown in FIGS. 1 and 2, comprises a plurality of vertical frames 1 spaced apart equidistant, two metal nets 2, 2' combined together.

Each frame 1 consists of two vertical parallel steel bars 10, 10 spaced apart with a distance of the thickness of a wall to be built, a zigzag steel bar 11 welded with and between the two steel bars 10, 10, and two vertical parallel angle steel posts 12, 12 bored with a multiplicity of holes 120 welded with the two vertical bars 10, 10.

Each metal net 2 or 2', cut from continuous net material to the length of a wall to be built, has a multiplicity of net holes and a plurality of horizontal parallel semi-round ridges 20 spaced equidistant, being attached on a flat surface of each front front and rear angle steel post 12 with screws N engaging tightly the holes 120 of the angle steel posts 12, 12.

In building a wall of this structure in a building, after a number of the spaced-apart frames 1 needed to have the length of the wall and the two metal nets 2, 2' of a length as same as the length of the wall are assembled together with the screws N. An empty space is then formed by the most outer two frames 1 and the two metal nets 2, 2', wherein fittings for electricity and water supply can be placed through between the frames. Then concrete material is poured from above or beside into the empty space surrounded by the two most outer frames 1, 1 and the two metal nets 2, 2'. After the concrete material has dried out and hardened, attached with the frames 1 and the two metal nets 2, 2', increasing strength of the wall, preventing cracks from occurring therein and keeping the wall surface substantially flat and smooth.

Figure 4:
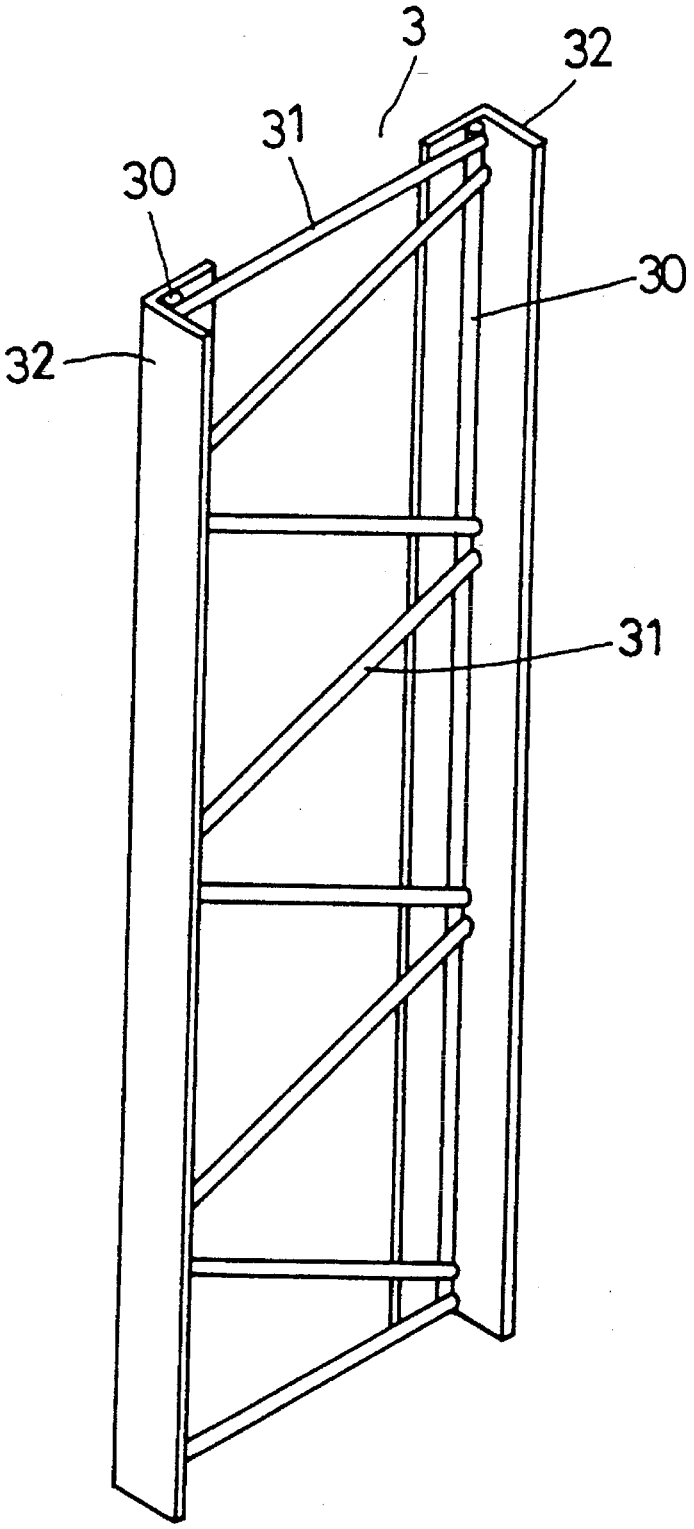
FIG. 4 is a perspective view of another structure for a frame of the first embodiment in the present invention.

The frame 1 can be altered in various ways, for example, as shown in FIG. 4, it can consist of a plurality of separate bars 31 in place of the zigzag bar 11 in the first embodiment, and the bars are welded in a zigzag shape with and between the two parallel vertical bars 30, 30. And two parallel angle steel posts 30, 30 are provided to be welded with the two steel bars 31, 31.

Figure 5:
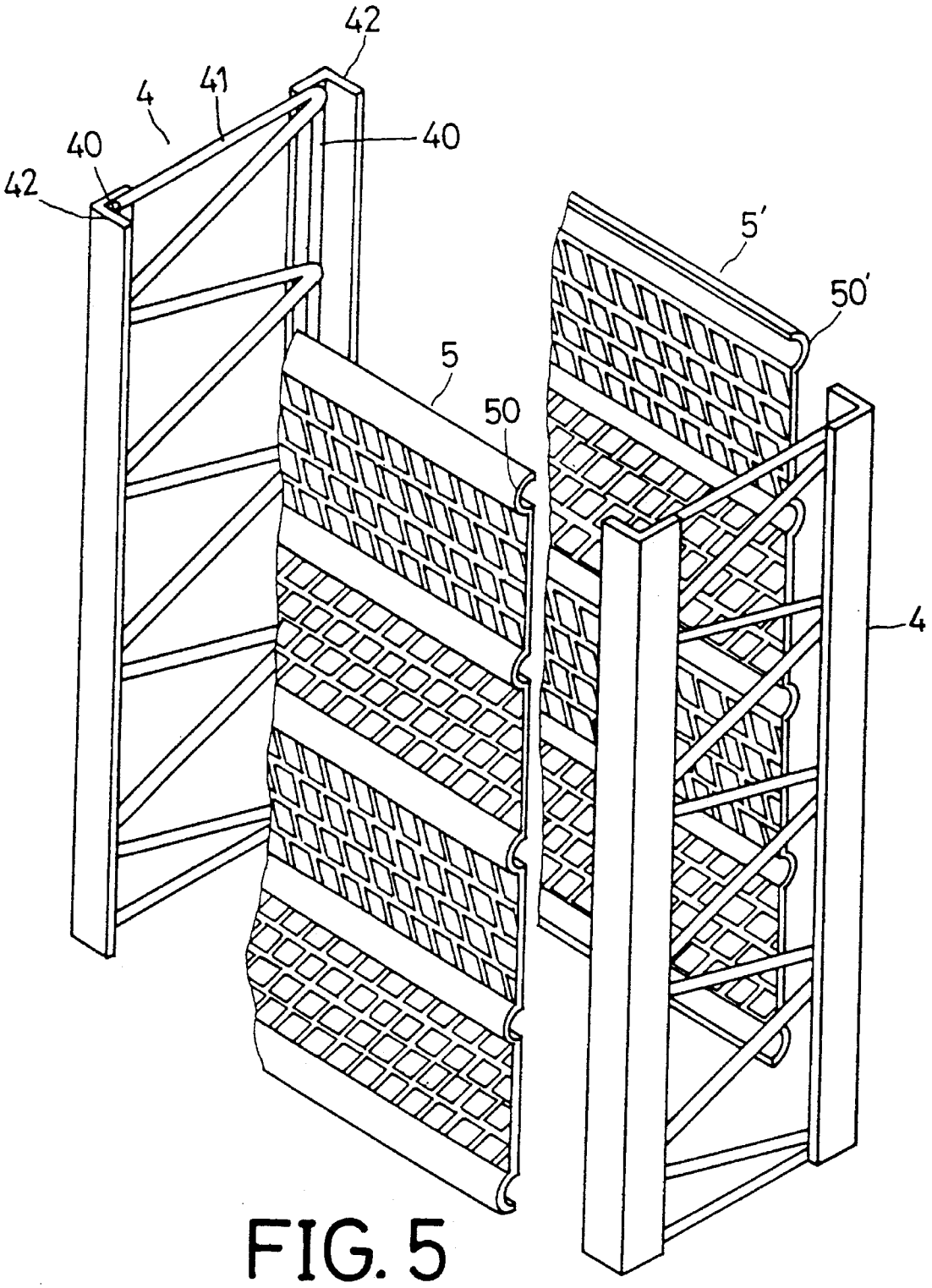
FIG. 5 is an exploded perspective view of a second embodiment of the wall structure for buildings in the present invention.
Figure 6:
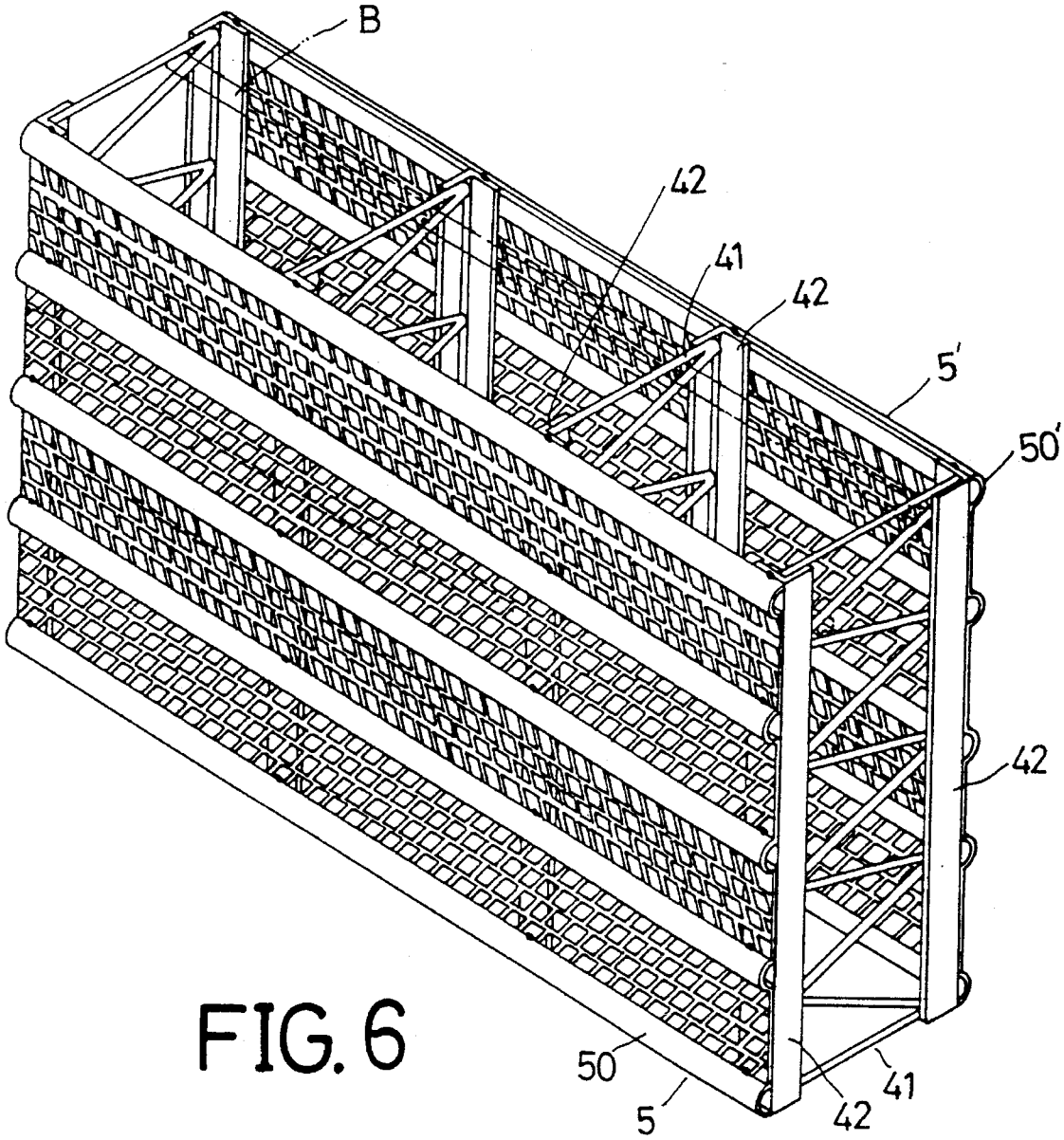
FIG. 6 is a perspective view of the second embodiment of the wall structure for buildings in the present invention.

Then a second embodiment of the wall structure of the present invention is shown in FIGS. 5 and 6, comprising a plurality of vertical frames 4 needed to meet the length of a wall and two metal nets 5, 5' of the same length of the wall welded together. Each frame 4 consists of two parallel vertical steel bars 40, 40 spaced with a distance of the thickness of a wall to be built, a zigzag bar 41 welded with and between the two vertical steel bars 40, 40, and two vertical parallel angle steel posts 42, 42 welded with the two vertical steel bars 40, 40. The two metal nets 5, 5' have the same structure as that in the first embodiment, having reinforcing semi-round ridges 50, 50' located horizontally and spaced equidistant. In building this wall, as shown in FIG. 6, a pre-determined number of the vertical frames 4 are prepared and the metal nets 5, 5' cut according to the needed length is welded on the flat surface of each front and each rear angle steel post 42. Then fittings for water and electricity are laid through the empty interior space formed by the frames 4 and the nets 5, 5'. After that, concrete material is poured in the empty interior space, and left to dry and harden. Then the frames, the metal nets and the concrete make up a reinforced concrete wall of substantial strength to withstand breakage and cracks to hold flatness and smoothness of the wall surface.

This new wall structure surely has the following advantages over the conventional wall structure above-mentioned.

1. The frames has zigzag bars giving sustaining force and strengthening the structure of a building to prolong life of the building.

2. In processing concrete material in this kind of wall, the whole length of the wall can be down at one time, unnecessary to divide the work many times separately, speeding building work.

3. No concrete forms are needed, saving working time and simplifying process.

4. It can decrease largely cost for building.

5. The wall surface has flatness and smoothness and hardly gives rise to cracks.

6. Fittings for water and electricity are quite easily installed.

What is claimed is:

1. A wall structure for buildings, comprising:

a plurality of vertical frames, each consisting of two vertical parallel steel bars spaced at a distance of the thickness of a wall to be built, a zigzag bar being welded with and between said two vertical steel bars, two vertical parallel angle steel posts spaced apart and respectively welded with the outer side of respective one of said two vertical steel bars; and two metal nets respectively having a length as the same as the length of a wall to be build and a height equal to the height of said vertical frames, a plurality of horizontal semi-round ridges spaced equidistant to strengthen the nets, and being fastened on one flat surface of the front and the rear angle steel posts respectively by means of screws.

* * * * *